US007908973B2

(12) United States Patent
De Lair et al.

(10) Patent No.: US 7,908,973 B2
(45) Date of Patent: Mar. 22, 2011

(54) LIGHTWEIGHT DEPLOYMENT SYSTEM AND METHOD

(75) Inventors: Charles M. De Lair, Pomerene, AZ (US); Christopher P. Owan, Tucson, AZ (US); Jeffrey P. Sowers, Tucson, AZ (US); Derek L. Budisalich, Tucson, AZ (US); Matthew B. Castor, Tucson, AZ (US); Matthew P. Francis, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 636 days.

(21) Appl. No.: 10/981,949

(22) Filed: Nov. 5, 2004

(65) Prior Publication Data

US 2009/0301457 A1 Dec. 10, 2009

(51) Int. Cl.
*F42B 12/58* (2006.01)

(52) U.S. Cl. ..... 102/489; 89/1.818; 89/1.8; 89/1.809

(58) Field of Classification Search ..... 102/489; 89/1.8, 1.818, 1.81, 1.801, 1.809, 1.813, 89/1.815

See application file for complete search history.

(56) References Cited

U.S. PATENT DOCUMENTS 3,285,175 A * 11/1966 Keenan ..... 60/225
3,363,508 A * 1/1968 Stahmer ..... 89/1.818
3,548,708 A * 12/1970 Hubigh ..... 89/1.818
3,631,803 A * 1/1972 Davis ..... 102/229
3,830,214 A * 8/1974 Curtis ..... 124/57
3,889,652 A * 6/1975 Curtis ..... 124/41.1
4,944,210 A * 7/1990 Flock et al. ..... 89/1.818
5,291,847 A * 3/1994 Webb ..... 114/331
5,407,092 A * 4/1995 Hardgrove et al. ..... 220/590
5,645,006 A * 7/1997 Moody ..... 114/238
5,762,057 A * 6/1998 Laabs et al. ..... 124/56
6,354,182 B1 * 3/2002 Milanovich ..... 89/1.818
6,672,239 B1 * 1/2004 Gieseke ..... 114/316

* cited by examiner

*Primary Examiner* — Michelle (Shelley) Clement

(74) *Attorney, Agent, or Firm* — The Noblitt Group, PLLC

(57) ABSTRACT

The disclosed system, device and method for deploying a sub-module from a carrier vehicle generally includes: a sub-module projectile (100) housed within a carrier vehicle; a rolling diaphragm (115) sealed between a first pressure chamber volume (145) and a second sub-module containment volume (e.g., substantially formed on the opposing side of rolling diaphragm 115 relative to pressure chamber 145); and a release mechanism (500), wherein the sub-module projectile (100) is secured until releasable deployment from the carrier vehicle. Disclosed features and specifications may be variously controlled, adapted or otherwise optionally modified to improve ejection, deployment and/or dispersal of a variety of sub-modules from a variety of carrier modules. Exemplary embodiments of the present invention generally provide for the ejection and dispersal of kinetic energy rod warheads from a kill-vehicle.

20 Claims, 6 Drawing Sheets

LIGHTWEIGHT DEPLOYMENT SYSTEM AND METHOD

FIELD OF INVENTION

The present invention generally provides for improved deployment of projectiles; and more particularly, representative and exemplary embodiments of the present invention generally relate to lightweight systems, devices and methods for the ejection and dispersal of kinetic energy rod warheads, equipment packages and/or the like, in exoatmospheric or reduced pressure environments.

BACKGROUND OF INVENTION

Methods for destroying missiles, aircraft, re-entry vehicles and other targets generally fall into three classifications: "hit-to-kill" vehicles, blast fragmentation warheads, and kinetic energy rod warheads.

"Hit-to-kill" vehicles are typically launched to a position proximate a re-entry vehicle or other target via a missile, such as the Patriot, Trident or MX. The kill vehicle is generally navigable and designed to strike a target re-entry vehicle rendering it inoperable. Countermeasures, however, may be employed to avoid the "hit-to-kill" vehicle. Moreover, biological warfare bomblets and chemical warfare submunition payloads may be carried by some threats and one or more of the bomblets or submunition payloads may survive, subsequently causing casualties even if the "hit-to-kill" vehicle accurately strikes its target.

Blast fragmentation type warheads have been designed to be carried by conventional missiles. Blast fragmentation warheads, unlike "hit-to-kill" vehicles, are generally not navigable; rather, when the missile carrier reaches a position proximate an enemy re-entry vehicle or other target, a preformed band of metal on the warhead is detonated and the pieces are accelerated with high velocity to strike the target. The fragments, however, are not always effective at destroying the target and, again, bomblets and/or submunition payloads may survive to cause casualties.

R. Lloyd's textbook, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of the Lloyd reference proposes a kinetic energy rod warhead.

The two primary advantages of kinetic energy rod warheads are: (1) they do not rely on precise navigation, as is the case with "hit-to-kill" vehicles; and (2) they provide improved penetration as compared with blast fragmentation warheads.

Kinetic energy rod warheads have not fully emerged from the design phase of their development cycle nor have they been widely accepted. The primary components associated with theoretical kinetic energy rod warheads proposed to date are a hull, a projectile core or bay in the hull (including a number of discrete projectiles), and an explosive charge in the hull about the projectile bay with explosive shields. When the explosive charge is detonated, the projectiles are deployed and dispersed.

The shaped projectiles, however, may tend to break and/or tumble in their deployment. Still other projectiles may approach the target at such a high oblique angle that they do not effectively penetrate the target. See, for example, "Aligned Rod Lethality Enhanced Concept for Kill Vehicles," R. Lloyd "Aligned Rod Lethality Enhancement Concept For Kill Vehicles" 10th AIAA/BMDD TECHNOLOGY CONF., Jul. 23-26, Williamsburg, Va., 2001 incorporated herein by this reference.

SUMMARY OF THE INVENTION

In various representative aspects, the present invention provides a low-cost, lightweight system, device and method for the deployment of a sub-module from a carrier vehicle in exoatmospheric and/or reduced pressure environments. Exemplary features generally include: a sub-module projectile housed within a carrier vehicle; a rolling diaphragm sealed between a first pressure chamber volume and a second sub-module containment volume; and a release mechanism, wherein the sub-module projectile is secured until released for deployment from the carrier vehicle.

Advantages of the present invention will be set forth in the Detailed Description which follows and may be apparent from the Detailed Description or may be learned by practice of exemplary embodiments of the invention. Still other advantages of the invention may be realized by means of any of the instrumentalities, methods or combinations particularly pointed out in the Claims.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent in light of certain exemplary embodiments recited in the Detailed Description, wherein:

Figure 1:
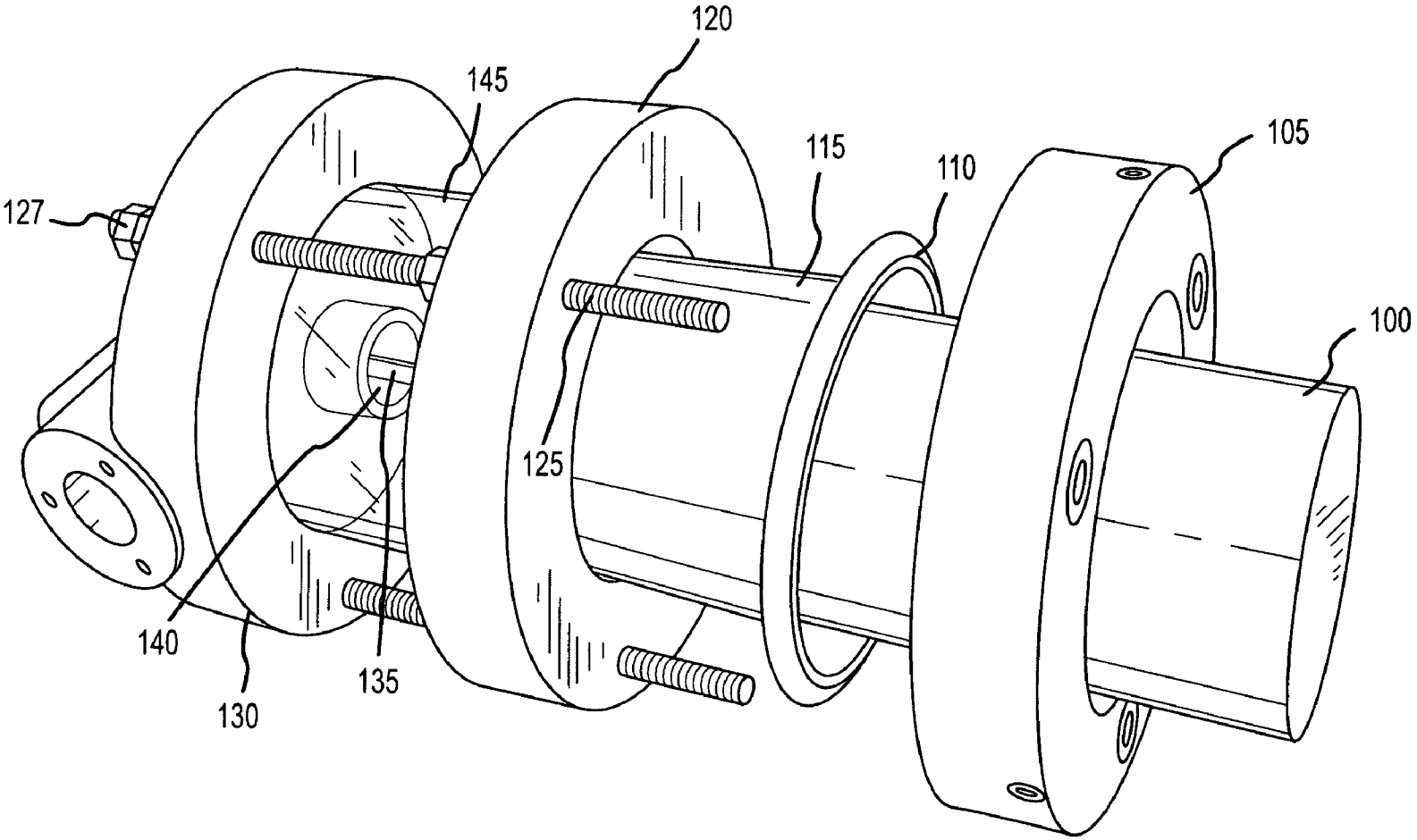
FIG. 1 representatively illustrates a partially exploded, perspective view of a lightweight ejection deployment system in accordance with an exemplary embodiment of the present invention.

Elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second", and the like herein, if any, are used inter alia for distinguishing between similar elements and not necessarily for describing a sequential or chronological order. Moreover, the terms "front", "back", "top", "bottom", "over", "under", and the like in the Description and/or in the Claims, if any, are generally employed for descriptive purposes and not necessarily for comprehensively describing exclusive relative position. Any of the preceding terms so used may be interchanged under appropriate circumstances such that various embodiments of the invention described herein may be capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventors' conception of the best mode, and are not intended to limit the applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

Various representative implementations of the present invention may be applied to any system for deploying a sub-module payload from a carrier module in exoatmospheric and/or reduced pressure environments. Certain representative implementations may include, for example: module deployments for orbital satellites; escape pod deployments for spacecraft; emergency ejection deployments for high-altitude aircraft; and kinetic energy warhead deployments from kill-vehicles.

As used herein, the terms "sub-module", "module", "pod", "rod", and "projectile", or any variation or combination thereof, are generally intended to include anything that may be regarded as at least being susceptible to characterization as, or generally referring to, objects that may be ejected or otherwise deployed from a carrier module, such as, for example: a pack; a package; a vehicle; a booster; an ejection chair; a sub-satellite; an instrument assembly; a kinetic energy warhead; and/or the like.

A detailed description of an exemplary application, namely a lightweight system, device and method for the deployment of kinetic energy projectiles from a kill vehicle, is provided as a specific enabling disclosure that may be generalized to any application of the disclosed system, device and method for sub-module deployment in exoatmospheric and/or reduced pressure environments in accordance with various embodiments of the present invention.

As discussed above, "hit-to-kill" vehicles are typically launched toward positions proximate re-entry targets via a missile. The kill vehicle (KV) may be navigable and designed to strike re-entry targets to render them inoperable. Countermeasures, however, may be employed to avoid the KV. Moreover, one or more submunition payloads may survive to cause casualties even if the KV accurately strikes its target.

Blast fragmentation warheads have been designed for deployment via missiles. When the missile reaches a position near an enemy re-entry vehicle (RV) or other target, a band of metal may be detonated with the fragmentation field striking the target. The fragments, however, are not always effective at destroying submunition payloads.

A kinetic energy rod warhead may be added to a KV to deploy projectiles directed at an RV or other target. Additionally, conventional blast fragmentation type warheads may be replaced or supplemented with kinetic energy rods for the deployment of projectiles towards a target. Two exemplary theoretical advantages of such a system are: (1) they generally do not rely on precise navigation, as may be the case with "hit-to-kill" vehicles, and (2) they provide improved penetration as compared with blast fragmentation warheads.

Representative components associated with conventional kinetic energy rod warheads include a hull, a projectile core or bay in the hull comprising a plurality of discrete rod projectiles, shield members, and explosive charges in the hull disposed about the bay or core. When the explosive charge is detonated, projectiles are deployed away from the carrier vehicle toward the target.

In explosive charge detonations, the projectiles may tend to break on deployment or tumble if the detonation is not well-controlled or the blast pattern is not subsequently formed. Accordingly, conventional explosive deployment mechanisms may result in projectiles approaching targets at such high oblique angles as to compromise their ability to effectively penetrate a target. Moreover, the explosive propellant, waste matter or other ejecta generated from explosive detonations may interfere with optical tracking and/or guidance systems of the carrier vehicle, thereby rendering subsequent salvo deployments less effective.

Missile systems have been suggested to achieve direct hits against ballistic missile intercepts; however, there exist missile engagement conditions where a warhead concept may often be more desirable. For example, a maneuverable kinetic energy rod warhead may be adapted to deploy, for example, thirty times more mass in the direction of a target as compared with traditional blast fragmentation warheads. Existing warheads typically have an inner core of high-density penetrators surrounded by explosives. A target's azimuthal orientation with respect to the warhead carrier vehicle will generally determine which explosive packs are detonated. Upon detonation of the packs, the rods are then deployed in the direction of the target. Conventional kinetic energy rod warhead designs have an explosive charge (C) to mass (M) ratio (C/M) on the order of about 0.2. The rods are deployed between 200 to 500 ft/sec and generally rely on relative engagement velocity to supply their penetration power.

Although explosively deployed rods tend to tumble randomly, techniques have been suggested (as generally disclosed, for example, in U.S. Pat. No. 6,779,462 to Lloyd, incorporated herein by this reference) to generate an aligned distribution of rods along a relative velocity vector. These rods may then penetrate deeper into a ballistic missile payload as compared with random contact vector distributions.

A SPHINX hydrocode simulation was performed to determine projectile rod penetration through thin steel plates as a function of oblique angle of incidence and yaw angles. A tungsten rod with an L/D of 30 was fired into a steel plate at 3 km/sec. The plate thickness was 4.9 mm and its angle of incidence was 60 degrees. Initial calculations, without the application of yaw, indicated that the rod maintained integrity and was stable after penetrating the steel plate.

The stability of a rigid body penetrator may be estimated by the following:

$$P_{cr} \cong \frac{\pi^2 E J_y}{\mu L^2}$$

where J is the moment of inertia of the cross-section, L is the length, μ is a dimensionless constant and E is the modulus of elasticity. A four wedge penetrator has a wedge thickness given by:

$$h = \sqrt{\frac{2}{2(x\tan\delta)}}$$

The angle δ is that of declination of an interior edge to the penetrator centerline. The distance x is measured along the axis of the penetrator. The polar moment of inertia of the penetrator is taken along the distance x and is generally defined as:

$$J_y = \frac{\pi}{4R^2} - 4\left(\frac{R^4}{8(b-a)} + \frac{\sqrt{R^2-h^2}}{12h} - \frac{h^3}{3\sqrt{R^2-h^2}-h}\right)$$

where $$b = \frac{\sqrt{R^2-h^2}}{R} \text{ and } a = \arcsin\left(\frac{h}{R}\right).$$

The radius R is the inner foundation of the penetrator. The polar moment of inertia for a cylindrical rod with radius r is:

$$J_y = \left(\frac{\pi}{4}\right)r^4$$

Accordingly, ratios of polar moments of inertia $$\frac{J_{y,1}}{J_{y,2}}$$

may be calculated along the a-axis of the penetrator for varying contact vectors.

Utilizing an empirical sealing model developed by Bless and Sataphathy at the Institute for Advanced Technology (IAT) in Austin, Tex., a yawed rod penetration model was applied for the evaluation of penetration efficiency as a function of contact vector of impacts. Where the full rod diameter is D, the rod length is L, the crater diameter is H, and the yaw is δ, the critical yaw $\delta_c$, for which the aft end of the rod contacts the entrance sidewall crater, is given as:

$$\delta_c = \sin^{-1}\left(\frac{\frac{H}{D}-1}{\frac{2L}{D}}\right)$$

Calculations were performed with 60 degrees of yaw. The rod easily penetrated the steel plate but experienced some bending on the nose of the rod. The curved section of the rod was observed to reduce its overall penetration performance.

Another calculation was performed with 16 degrees of yaw and demonstrated that thin plates were easily penetrated. Increasing yaw angles, however, induced a large force on the contact point of the rod. The rods easily penetrated the plates but subsequently fractured and broke. Accordingly, it would be expected that there would be reduced overall penetration into submunition or bomblet payloads.

These calculations also demonstrated that long cylindrical rods should be optimally aligned in order to gain the added penetration benefit from long rod geometries, since cylindrical rods with large L/D ratios have a tendency to bend and break after penetrating a target plate at high obliquity with yaw.

In various embodiments in accordance with the present invention, a kinetic energy rod warhead deployment system may include means for aligning discrete projectiles during any phase of deployment in order to provide an improved penetration angle. For example, such means may include those as described in U.S. Pat. No. 6,779,462 in addition to other means, whether now known, subsequently discovered or otherwise described in the art.

As generally depicted in FIG. 1, a representative embodiment of the present invention provides a lightweight system, device and method for deploying a projectile 100 from a carrier vehicle in a predictable, smooth, reproducible, and aligned ejection vector. For the purposes of describing exemplary features found in FIG. 1, a carrier vehicle may be representatively understood to comprise the aggregation of bulkheads 105, 120, 130 secured by threaded screws 125 and nuts 127.

Figure 2:
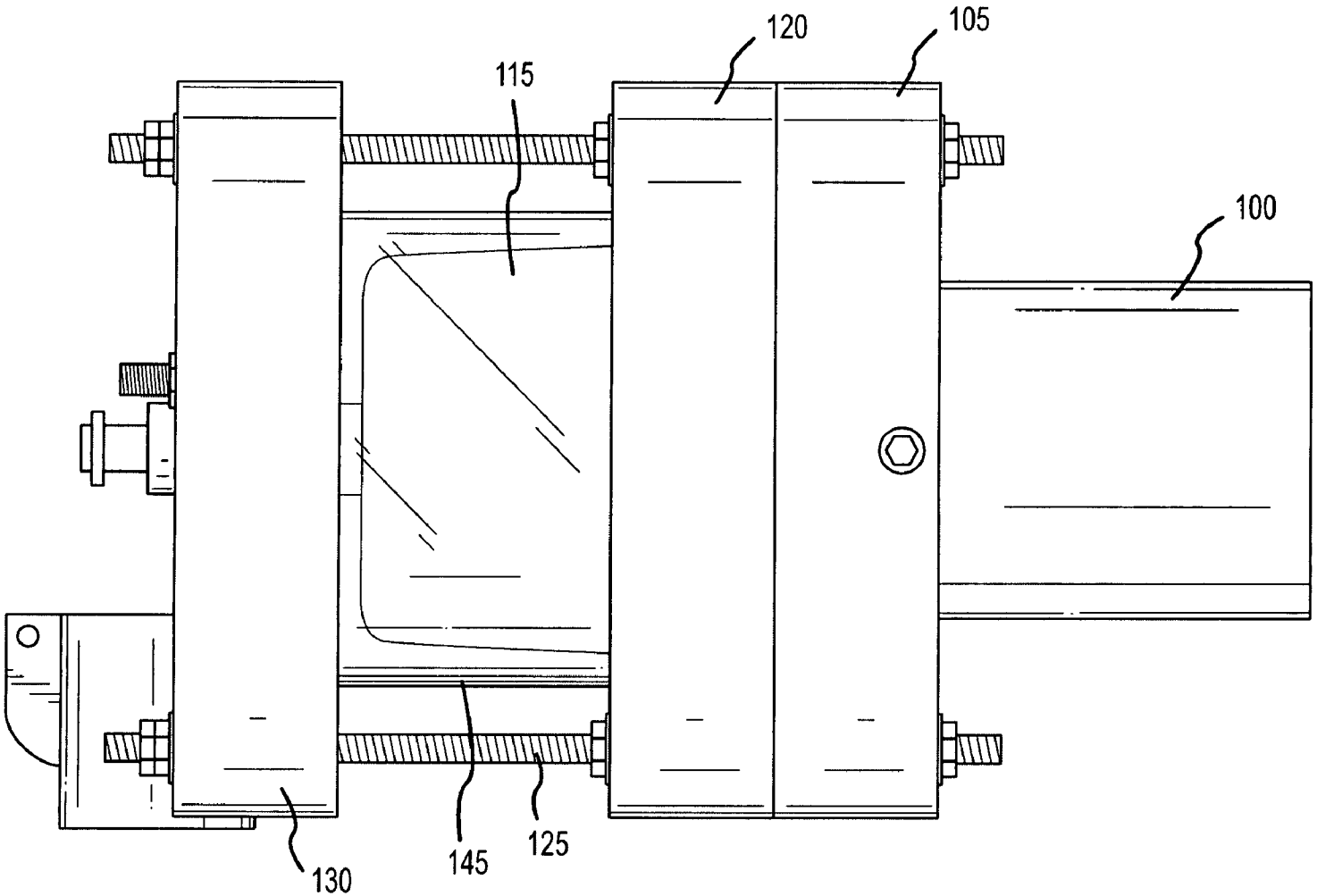
FIG. 2 representatively illustrates a plan view of an assembled lightweight ejection device in accordance with an exemplary embodiment of the present invention.
Figure 3:
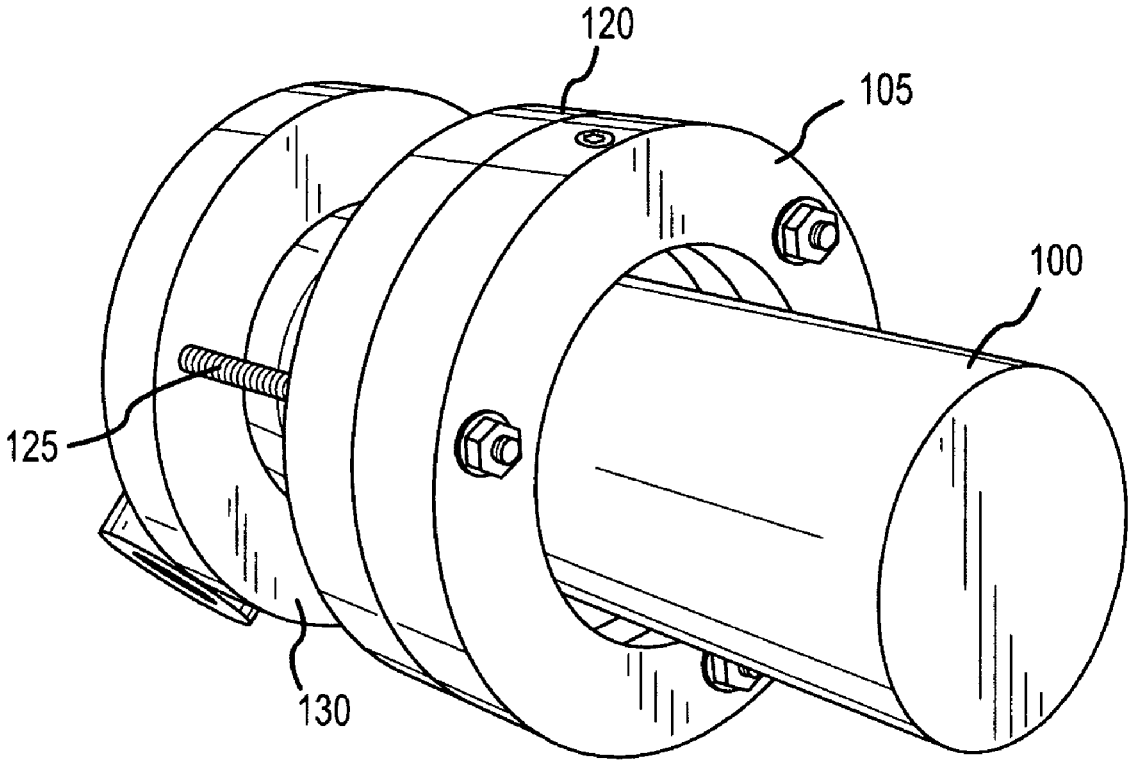
FIG. 3 representatively illustrates a perspective view of the lightweight ejection device generally depicted in FIG. 2, in accordance with an exemplary embodiment of the present invention.

The ejection of projectile 100 is generally accomplished by supplying a gas pressure differential across a rolling diaphragm 115. For example, rolling diaphragm 115 may comprise an annular seal portion 110 disposed between forward diaphragm bulkhead 105 and aft diaphragm bulkhead 120. As threaded screws 125 are engaged to secure rear bulkhead 130, aft diaphragm bulkhead 120 and forward diaphragm bulkhead 105, seal portion 110 of rolling diaphragm 115 becomes pinched between aft diaphragm bulkhead 120 and forward diaphragm bulkhead 105 to form a first seal between pressure chamber 145 and the projectile containment volume substantially formed on the opposing side of rolling diaphragm 115 (e.g., where projectile 100 is generally disposed in a sleeve-like configuration with respect to rolling diaphragm 115). FIGS. 2 and 3 generally depict the partially exploded exemplary device shown in FIG. 1 in an assembled configuration in both plan and three-quarter perspective views respectively. Projectile 100 is generally suitably adapted for releasably retained engagement within the carrier module. Ball-lock pin 135 is configured for engagement with an aft receiving portion of projectile 100 such that the ball-lock mechanism may be operated to release projectile 100 from engagement with the carrier module. In the representative and exemplary embodiment generally depicted in FIG. 1 for example, ball-lock pin 135 may be configured for projection through bulkhead opening 140 into pressure chamber 145.

It will be appreciated that various other means for providing a release mechanism, wherein projectile 100 may be retained in a substantially stowed position until the release mechanism is actuated to engage deployment, may be alternatively, conjunctively or sequentially employed to achieve a substantially similar result. For example, projectile 100 may be releasably retained with a pin, a rod, a clip, a post, a slat, a wedge, a flap, a wire, a screw, a bolt, a shear pin, a sear and/or any other type of release mechanism or other device whether now known or otherwise hereafter described in the art.

Figure 4:
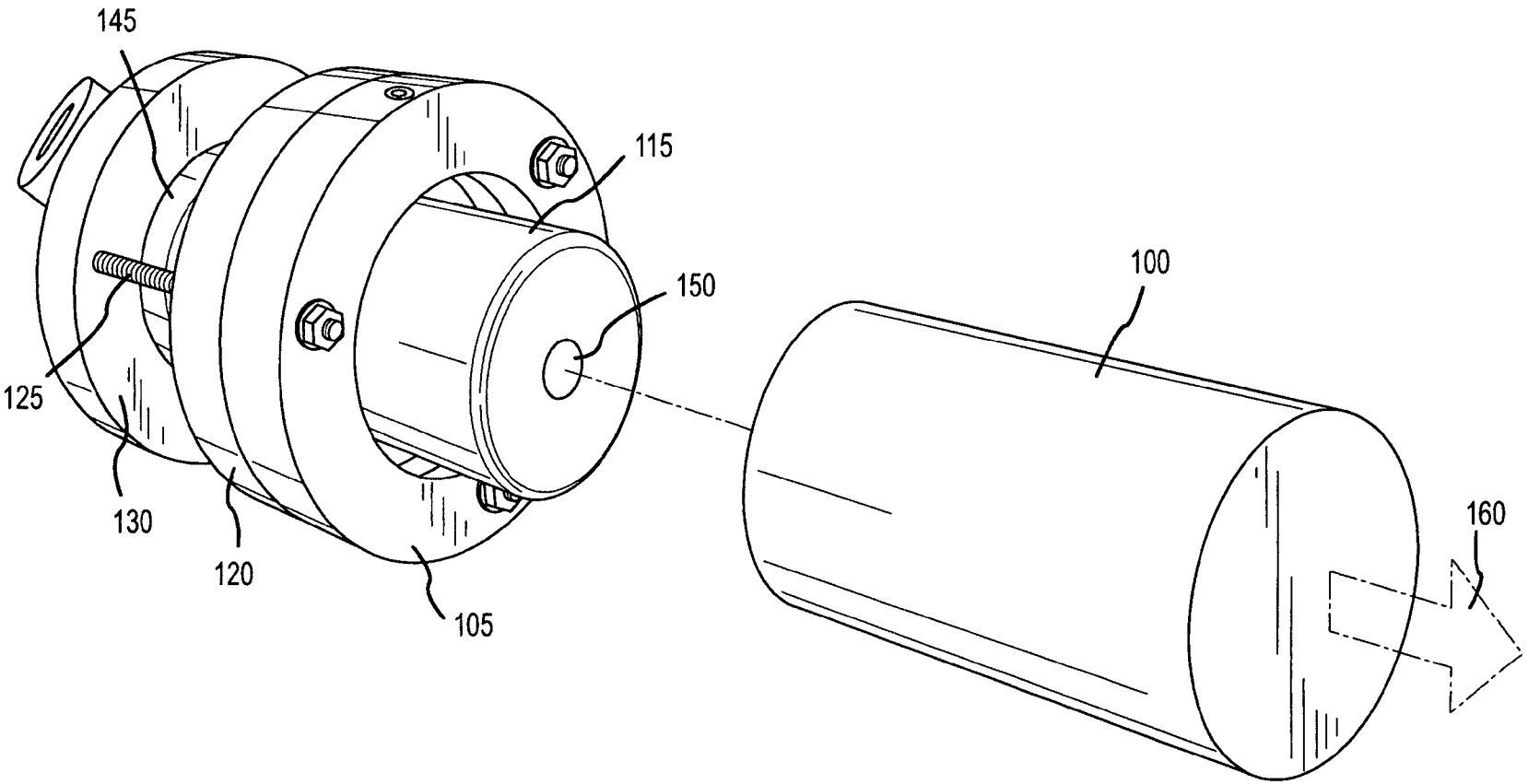
FIG. 4 representatively illustrates a perspective view of a lightweight ejection system and deployed projectile in accordance with an exemplary embodiment of the present invention.

In the embodiment where the release mechanism comprises a ball-lock pin 135, rolling diaphragm 115 may be configured with an opening 150, as generally depicted for example in FIG. 4, to permit retention of projectile 100. Additionally, bulkhead opening 140 and/or rolling diaphragm 115 may be suitably adapted with a second sealing element (for example, an o-ring and/or the like) such that diaphragm opening 150 generally experiences a substantially secure seal between pressure chamber 145 and the projectile containment volume formed on the opposing side of rolling diaphragm 115 with respect to pressure chamber 145.

Pressure chamber 145 may be adapted to retain a volume of atmospheric gas at a pre-determined pressure. For example, during production, handling and maintenance in terrestrial environments at normal atmospheric pressure, pressure chamber 145 may be substantially open to the ambient atmosphere. Alternatively, conjunctively or sequentially, various elements of the disclosed exemplary system may be at least partially sealed yet permeable to atmospheric gases in order to allow the nominal pressure of gas in pressure chamber 145 to equilibrate with the pressure of the external environment over time. Additionally, pressure chamber 145 may be configured to provide a quick-closure seal upon subjection to a relatively rapid barometric pressure differential, such as might occur during a booster vehicle launch, for example. In accordance with various representative embodiments of the present invention, ball-lock 135 general provides releasable retention of projectile 100 while maintaining a differential gas pressure across rolling diaphragm 115.

In representative applications in accordance with exemplary aspects of the present invention, the trapping of atmospheric gas at normal atmospheric pressure in a terrestrial environment would permit the disclosed deployment system to be relatively harmless with respect to handling on earth. For example, in a terrestrial environment, even if the release mechanism were accidentally engaged, rolling diaphragm 115 would not experience a pressure differential capable of deploying projectile 100.

Accordingly, various embodiments of the present invention utilize a pressure differential between pressure chamber 145 and the external environment (at reduced pressure upon deployment) to provide the application force to eject projectile 100. As depicted in FIG. 4 for example, upon release and deployment, the gas pressure in chamber 145 generally forces rolling diaphragm 115 to an extended position thereby propelling projectile 100 in the direction of deployment 160.

In accordance with various representative embodiments of the present invention, there are substantially no byproducts or other materials produced by any of the disclosed deployment systems generally depicted in the Figures. This is not the case, however, for conventional explosive deployment methods where combustion byproducts and other ejecta may operate to interfere with, for example, optical guidance or tracking systems. Accordingly, various representative embodiments of the present invention may be employed to meet or exceed the specifications 'Class 100' optical compliance. Moreover, representative embodiments of the present invention generally have no requirements to use pre-pressurized gases to maintain a pressure differential across rolling diaphragm 115. Additionally, there is no requirement for complicated actuators or heavy mechanically driven assemblies.

Figure 5:
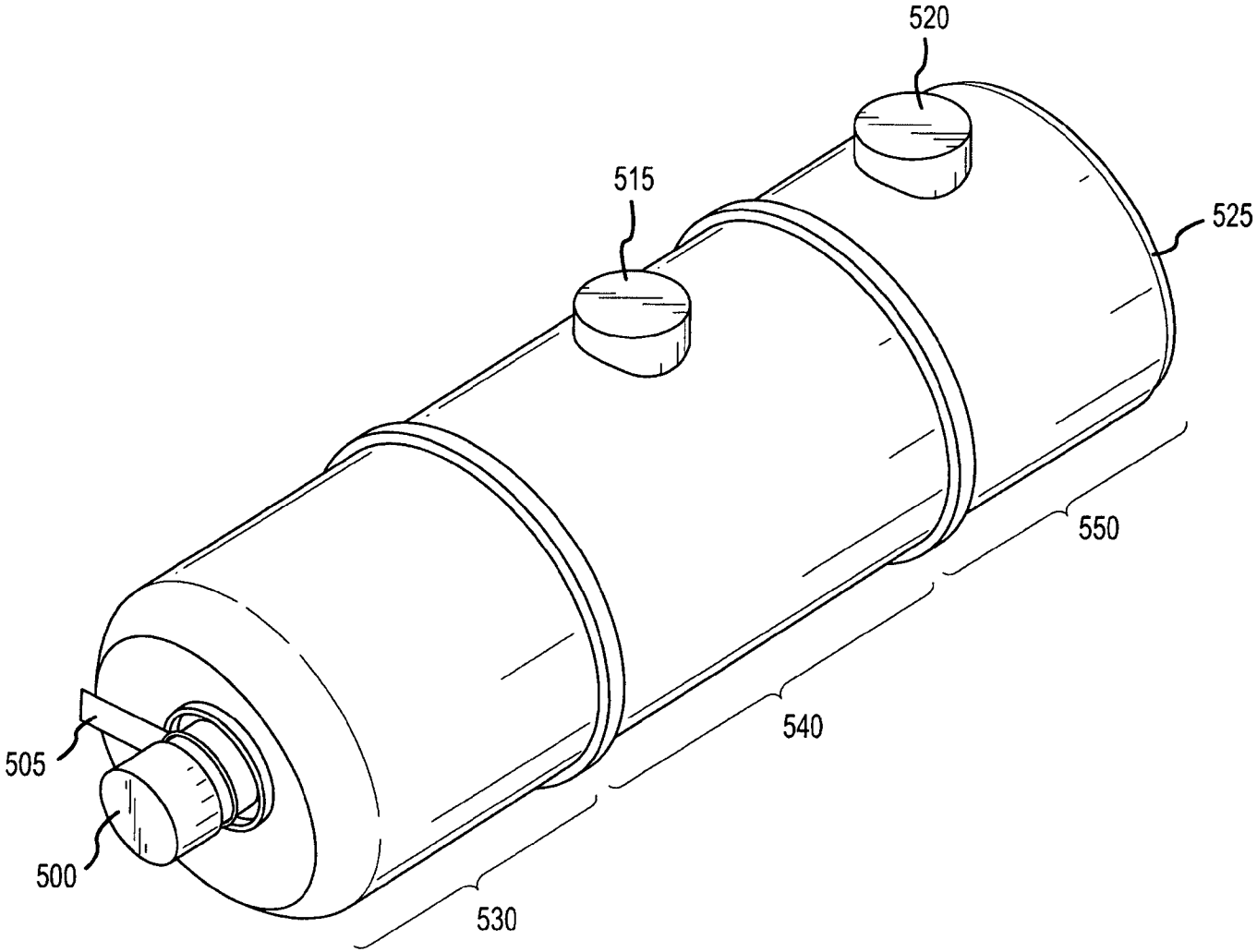
FIG. 5 representatively illustrates a perspective, aft view of a kinetic energy projectile deployment device in accordance with another exemplary embodiment of the present invention.
Figure 6:
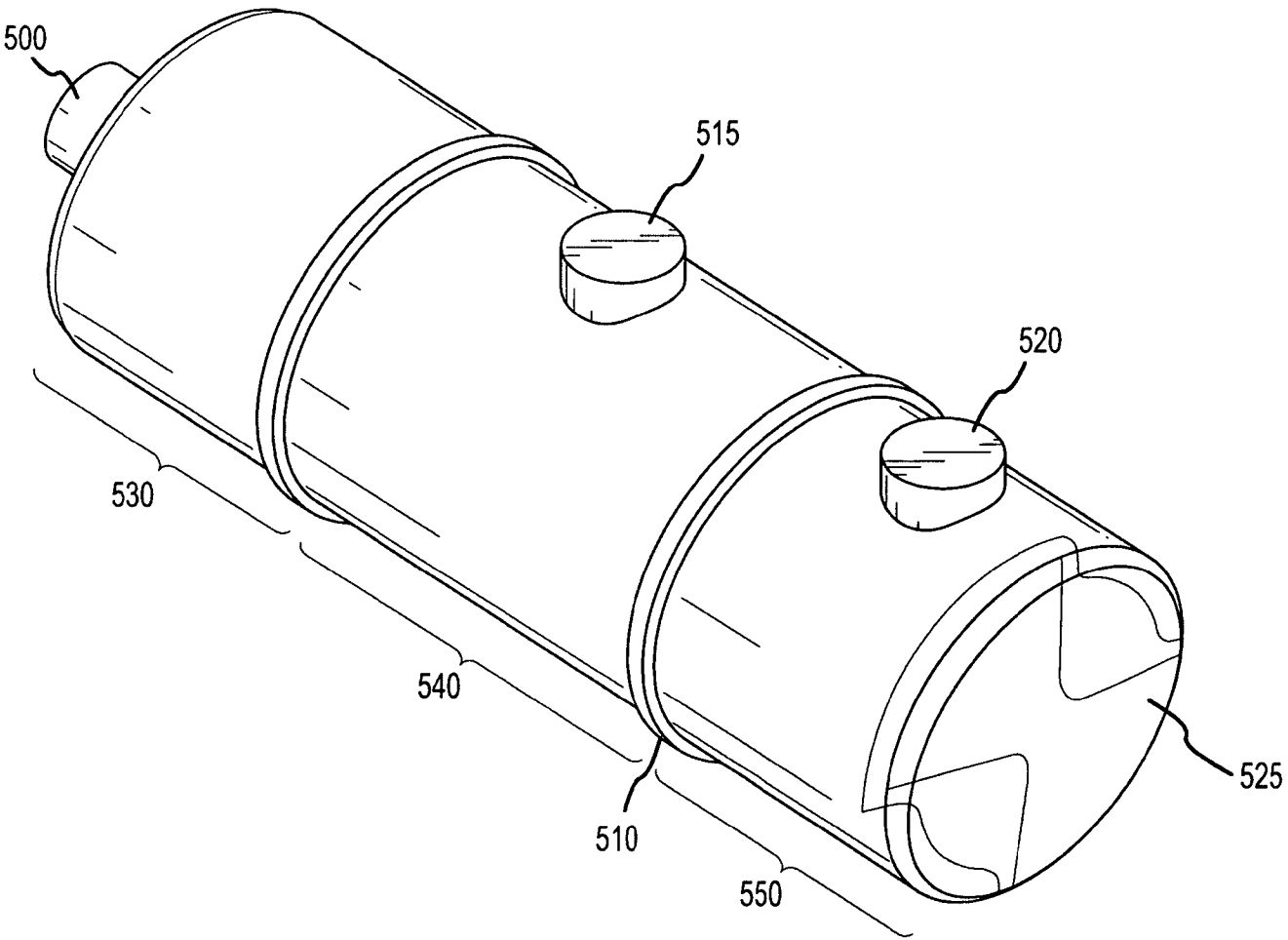
FIG. 6 representatively illustrates a perspective, forward view of the kinetic energy projectile deployment device generally depicted in FIG. 5, in accordance with an exemplary embodiment of the present invention.

FIGS. 5 and 6 generally depict an exemplary containment module for KV deployment devices representatively shown in FIGS. 1 thru 4. A plurality of containment modules may be configured in a pod assembly, with discrete modules operating to protect KV deployment devices disposed therein from the external environment. The containment module may comprise a plurality of sections 530, 540, 550 wherein bulkheads 510 may provide structural mounting and/or handling points in order to secure the containment module. The containment module may further comprise a data umbilical 505 for uni- or bi-directional data transfers to perform diagnostic analyses of the KV deployment device. The containment module may also comprise a volume for receiving a desiccant 515 in order to prevent the build-up and/or introduction of moisture within the containment volume. The containment module may further be configured with one or more burst disks 520 such that a differential in pressure between the interior of the containment module and the exterior may cause burst disk 520 to rupture to release pressure.

The containment module may also include a metallic frangible cover 525 that may be optionally pre-scored to permit a deployed projectile 100 to pass through cover 525 while effectively sealing the containment module interior volume from the external environment prior to deployment of projectile 100. The containment module may be fabricated from thin-walled aluminum sections 530, 540, 550 with a release mechanism 500 disposed at the aft end of the containment module. As described vide supra, release mechanism 500 may comprise a pneumatically actuated ball-lock or such other means now known, or otherwise hereafter described in the art.

In general, the KV deployment device may be installed within the containment module and the tube closed with cover 525. A desiccant 515 may then be provided and the containment module subjected to a dry nitrogen purge of its interior volume. At atmospheric pressure, release mechanism 500 will generally not deploy projectile 100, even if release mechanism 500 is accidentally engaged, since rolling diaphragm 115 does not experience a pressure differential. Access and removal of the KV device in silo may be made possible by access gained from shroud removal, thereby providing logistical advantages. The thin walled containment sections 530, 540, 550 may be sensitive to handling damage and indentation. Accordingly, space vehicle workmanship processes may be employed.

Deployment of projectile 100 is generally accomplished with an accurate, reproducible and predictable acceleration profile. A representative prototype, designed in accordance with an exemplary embodiment of the present invention, achieved a peak deployment velocity of 5.65 m/sec with smooth acceleration. Salvo deployments of a plurality of projectiles may be accomplished by successive pneumatic activation of a plurality of release mechanisms. Deployments may be engaged in a wave pattern as a function of location or disposition of projectiles on the carrier vehicle, for example. Orientation of projectiles on the carrier vehicle may be suitably adapted to provide a conic or hemispherical deployment volume. The release mechanisms may further include a replaceable indicator wire to indicate activation of the release mechanism.

Rolling diaphragm 115 may comprise an elastomeric, polymeric, metallic or rubberized material, or such other materials whether now known or otherwise hereafter described in the art. Alternatively, conjunctively or sequentially, rolling diaphragm 115 may comprise a material that is at least partially permeable to at least one atmospheric gas. In general, the materials used for fabrication of rolling diaphragm 115 may be selected as a function of gas permeability and/or diffusion rate so that rolling diaphragm 115 does not experience a convolution reversal, thereby rendering diaphragm 115 inoperable.

Various representative embodiments of the present invention generally provide lightweight deployment systems having deployment sub-system to projectile mass ratios on the order of substantially less than 0.2. A prototype deployment device in accordance with an exemplary embodiment of the present invention demonstrated a deployment sub-system to projectile mass ratio of about 0.05. In applications where the deployment device comprises a kinetic energy rod warhead, such weight savings may provide significant advantages when used with conventional booster vehicle inventories. Accordingly, the present invention provides a lightweight, low-cost, self-contained and safe system for deploying a projectile payload from a carrier module in exoatmospheric or reduced pressure environments.

In the foregoing specification, the invention has been described with reference to specific exemplary embodiments; however, it will be appreciated that various modifications and changes may be made without departing from the scope of the present invention as set forth in the claims below. The specification and figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

We claim:

1. A carrier vehicle for deploying a projectile into a surrounding environment, comprising:

a pressure chamber;

a flexible seal extending into the pressure chamber, wherein the flexible seal is configured to:

seal the pressure chamber from the surrounding environment, wherein the seal seals a gas within the pressure chamber at terrestrial atmospheric pressure;

form a containment volume subject to an ambient pressure of the surrounding environment; and contain the projectile at least partially within the containment volume;

a release mechanism coupled to the pressure chamber and selectively engaging the projectile, wherein the release mechanism is configured to selectively deploy the projectile from the containment volume by disengaging from the projectile and allow an expansion of the gas to act on the flexible seal when the ambient pressure of the surrounding environment pressure is at least one of exoatmospheric and subatmospheric.

2. A carrier vehicle according to claim 1, wherein the flexible seal is further configured to extend outward from the pressure chamber following the expansion of the gas.

3. A carrier vehicle according to claim 1, wherein the containment volume comprises a sleeve substantially conforming to the shape of the projectile.

4. A carrier vehicle according to claim 1, wherein the flexible seal comprises a rolling diaphragm.

5. A carrier vehicle according to claim 4, wherein the rolling diaphragm comprises at least one of a polymeric, an elastomeric, a metallic, and a rubberized material.

6. A carrier vehicle according to claim 4, wherein the rolling diaphragm is at least partially porous to the gas.

7. A carrier vehicle according to claim 1, wherein the release mechanism comprises at least one of a ball-lock, a burst disk, a pressure regulator, a filter, a tank, a pyrotechnic valve, a pin, a rod, a clip, a post, a slat, a wedge, a flap, a wire, a screw, a bolt, a shear pin, and a sear.

8. A carrier vehicle according to claim 1, wherein the release mechanism is further configured to extend through the flexible.

9. A deployment system for a reduced pressure ambient environment, comprising:

a pressure chamber disposed between a first and second bulkhead;

a third bulkhead positioned adjacent to the second bulkhead;

a flexible seal secured between the second and third bulkheads, wherein the flexible seal:

extends into the pressure chamber;

seals the pressure chamber with a gas at terrestrial atmospheric pressure; and forms a containment volume subject to an ambient pressure of the ambient environment;

a projectile at least partially retained within the containment volume; and a release mechanism connected to the pressure chamber and engaging the projectile, wherein the release mechanism is configured to selectively deploy the projectile from the containment volume by disengaging from the projectile and allow an expansion of the gas within the pressure chamber to extend the flexible seal outward from the pressure chamber when the reduced pressure ambient environment is less than the terrestrial atmospheric pressure used to seal the pressure chamber.

10. a deployment system according to claim 9, wherein the flexible seal comprises a rolling diaphragm.

11. a deployment system according to claim 10, wherein the rolling diaphragm comprises at least one of a polymeric, an elastomeric, a metallic, and a rubberized material.

12. a deployment system according to claim 10, wherein the rolling diaphragm is at least partially porous to the gas.

13. a deployment system according to claim 9, wherein the containment volume forms a sleeve substantially conforming to the portion of the projectile retained within the containment volume.

14. a deployment system according to claim 9, further comprising a containment module to substantially enclose the deployment system.

15. a deployment system according to claim 9, wherein the projectile comprises a kinetic energy rod warhead.

16. A method for deploying a projectile in a reduced pressure environment, comprising:

sealing a pressure chamber with a gas at ambient atmospheric terrestrial pressure wherein sealing the pressure chamber comprises securing a flexible seal over an opening of the pressure vessel such that the flexible seal extends into the pressure chamber and forms a containment volume subject to an ambient environmental pressure and sufficient to receive the projectile;

engaging the projectile with a release mechanism connected to the pressure chamber;

deploying the projectile by disengaging the release mechanism from the projectile when the ambient environmental pressure is less than the pressure of the gas within the sealed pressure chamber, wherein disengaging the release mechanism allows the gas to expand and act upon the flexible seal.

17. A method for deploying a projectile according to claim 16, wherein the expanding gas causes the flexible seal to extend outwards from the pressure chamber.

18. A method for deploying a projectile according to claim 16, wherein the flexible seal comprises a rolling diaphragm.

19. A method for deploying a projectile according to claim 16, wherein the flexible seal comprises a sleeve substantially conforming to the shape of the projectile.

20. A method for deploying a projectile according to claim 16, wherein the projectile comprises a kinetic energy rod warhead.

* * * * *